US006644990B1

(12) United States Patent
Okabe et al.

(10) Patent No.: US 6,644,990 B1
(45) Date of Patent: Nov. 11, 2003

(54) CONNECTOR SUPPORT STRUCTURE

(75) Inventors: Toshiaki Okabe, Shizuoka-ken (JP); Kenji Oishi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/714,515

(22) Filed: Nov. 17, 2000

(30) Foreign Application Priority Data

Dec. 3, 1999 (JP) ..... P 11-345003

(51) Int. Cl.[7] ..... H01R 13/62
(52) U.S. Cl. ..... 439/157; 439/544; 439/372
(58) Field of Search ..... 439/157, 544, 439/160, 152, 310, 372, 545, 546, 547, 548, 549, 550–559, 562–567

(56) References Cited

U.S. PATENT DOCUMENTS 4,405,196 A * 9/1983 Fulton ..... 439/551
5,496,186 A * 3/1996 Dobbelaere et al. ..... 439/157
5,772,469 A * 6/1998 Polgar et al. ..... 439/546
6,012,933 A * 1/2000 Katsuma ..... 439/157
6,186,827 B1 * 2/2001 Okabe ..... 439/544

FOREIGN PATENT DOCUMENTS

JP 10021992 1/1998

* cited by examiner

*Primary Examiner*—Ross Gushi
(74) *Attorney, Agent, or Firm*—Finnegan, Henderson, Farabow, Garrett, & Dunner, L.L.P.

(57) ABSTRACT

A first connector has a rear end side supported by a part to be assembled. A second connector is to be fitted with the first connector to be mounted from a front end side thereof. The first connector and the second connector are electrically joined each other. The part to be assembled includes an engagement panel engaged with the first connector. The first connector includes a first connector body, and a rotary member for engagement which is supported to the first connector body by a supporting axis for a free end of the rotary member to project from a rear end face of the first connector body. The rotary member includes a rear engagement projection engaging with a back face of the engagement panel, and a front engagement projection engaging with a front face of the engagement panel. The front engagement projection is positioned to generate a tangential force for rotating the rotary member about the supporting axis when the second connector is fitted with the first connector.

14 Claims, 11 Drawing Sheets

CONNECTOR SUPPORT STRUCTURE

BACKGROUND OF THE INVENTION

1. Field of the Invention

The present invention relates to a connector and a connector support structure.

2. Description of Relevant Art

Conventionally, this kind of a connector support structure of a technology according to Japanese Patent Application Laid-Open Publication No. 10-21992 has been known.

The connector support structure is generally composed of a holder to be mounted to a hole defined by a part to be assembled such as a stay member of an automobile, a first connector slidably fitted in the holder, a second connector joined to a side of electronic unit, and a rotary lever supported by a supporting axis on the first connector, the lever to drive the second connector in a direction for connection with the first connector.

SUMMARY OF THE INVENTION

However, the connector support structure is configured such that a pin to be driven of the second connector is inserted in a engagement groove formed at a lower face of a front end of the lever, an engagement pin projecting at a rear end of the lever is inserted in a guide groove, and respective pins are guided, being slid in respective grooves. Thus, when pushing and fitting the second connector, a frictional resistance occurs between the respective pins and the respective grooves for insertion of the respective pins, so that a great insertion load is necessary for assembly of the second connector.

The connector support structure has necessity that the engagement pin is fitted when inserting the first connector in the holder assembled to the part to be mounted. With the first connector being inserted in the holder, the lever can rotate freely, and an operation to make the engagement pin inserted in the guide groove needs a skill. Thus, there is a drawback that an assembly operation is complicated.

An object of the invention is to provide a connector support structure and a connector which make assembly performed reliably and easily by a small insertion load.

To achieve the object, a first aspect of the present invention provides a connector support structure. The structure includes a first connector which has a rear end side supported by a part to be assembled. A second connector is to be fitted with the first connector to be mounted from a front end side thereof. The first connector and the second connector are electrically joined each other. The part to be assembled includes an engagement panel engaged with the first connector. The first connector includes a first connector body; and a rotary member for engagement which is supported to the first connector body by a supporting axis for a free end of the rotary member to project from a rear end face of the first connector body. The rotary member includes a rear engagement projection engaging with a back face of the engagement panel; and a front engagement projection engaging with a front face of the engagement panel. The front engagement projection is positioned to generate a tangential force for rotating the rotary member about the supporting axis when the second connector is fitted with the first connector.

Preferably, the front engagement projection is positioned on a rotation side of the rotary member to rotate about the supporting axis relative to a fitting line. The fitting line passes through the supporting axis in a fitting direction where the second connector is fitted with the first connector.

According to the invention, the front engagement projection is positioned to generate a tangential force for rotating the rotary member about the supporting axis, and a fitting force from the second connector to the first connector and an engagement force between the rotary member and the part to be assembled are remarkably reduced. Thus, connectors are simply fitted each other with a small push force and the first connector and the part to be assembled are fitted each other with a small push force in the identical way. As described above, the fitting force (load at fitting) of the first and the second connectors is remarkably reduced, and an assembly of a connector is easier and reliably.

A second aspect of the present invention provides a connector which includes a first connector having a rotary member. The rotary member has a first engagement member and a second engagement member thereon for holding a part to be assembled therebetween.

Preferably, the first engagement member has a first point with a first radius and a first angle, and a second engagement member has a second point with a second radius and at a second angle. The first radius and the second radius are different each other. The first angle and the second angle are different each other.

Preferably, the second radius is smaller than the first radius, and the second angle leads the first angle.

Preferably, the second engagement member extends radially inward on the rotary member.

Preferably, the first connector includes a third engagement member, and the rotary member defines a cut-out part for engagement with the third engagement member.

Preferably, the connector further includes a second connector configured to be fitted with the first connector, and the second connector has a fourth engagement member with a side to be brought in contact with the rotary member.

Preferably, the rotary member includes an engagement protrusion to be engaged with another side of the fourth engagement member.

Preferably, the first engagement member includes a resilient part to engage with the part to be assembled.

BRIEF DESCRIPTION OF THE ACCOMPANYING DRAWINGS

DETAILED DESCRIPTION OF THE PREFERRED EMBODIMENTS

Figure 1:
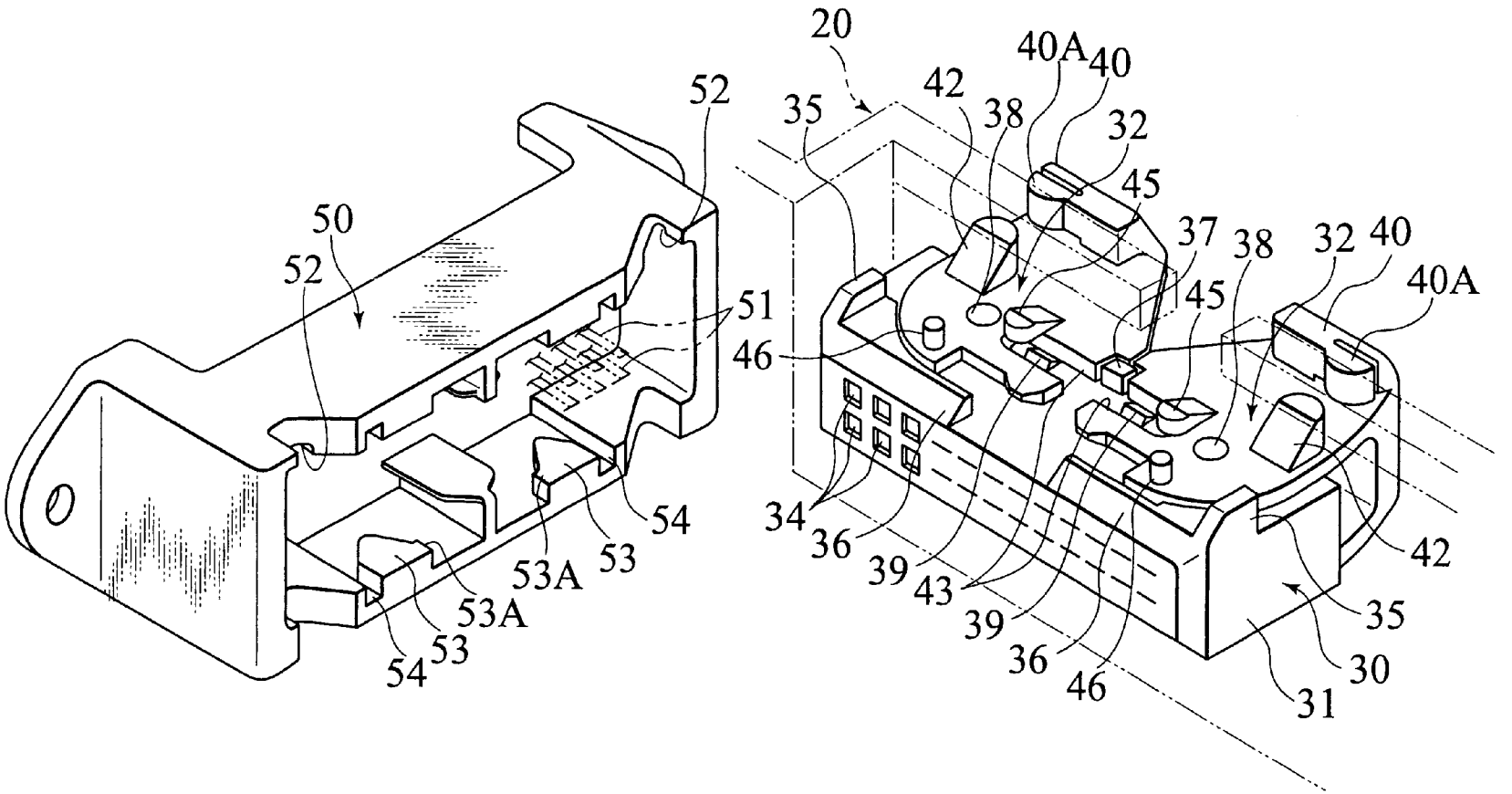
FIG. 1 is a perspective view showing an embodiment of a connector support structure according to the present invention.

Details of a connector support structure according to the present invention will be described below based on an embodiment shown in the drawings.

The connector support structure of the present embodiment is generally formed of a part 20 to be assembled provided on a stay member side of an automobile, for example, a first connector 30 to be assembled in the part 20, and a second connector 50 to be mounted to the first connector 30 as shown in FIG. 1.

Figure 2:
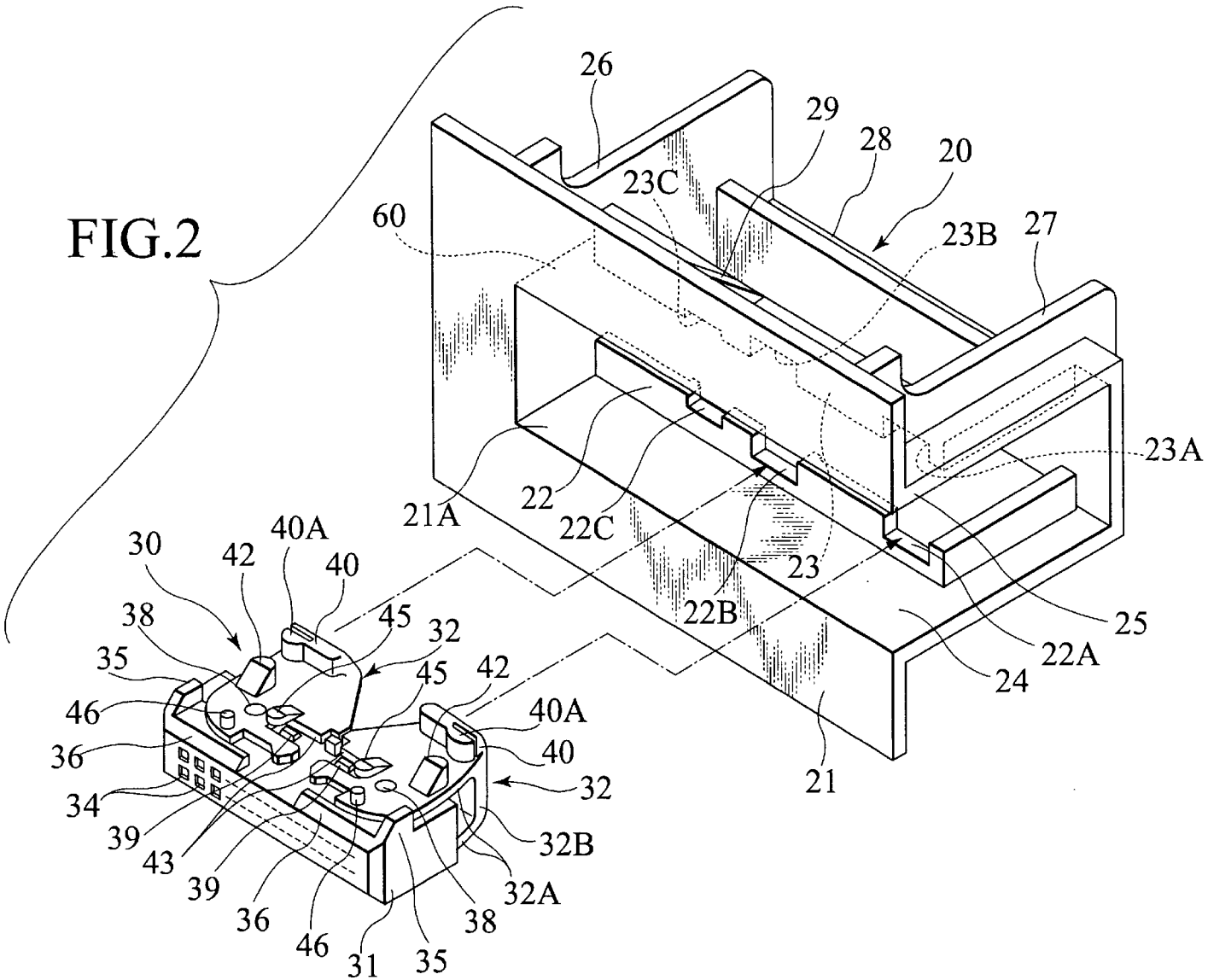
FIG. 2 is a perspective view showing a state in which a first connector is assembled in a part to be assembled in the embodiment.
Figure 3:
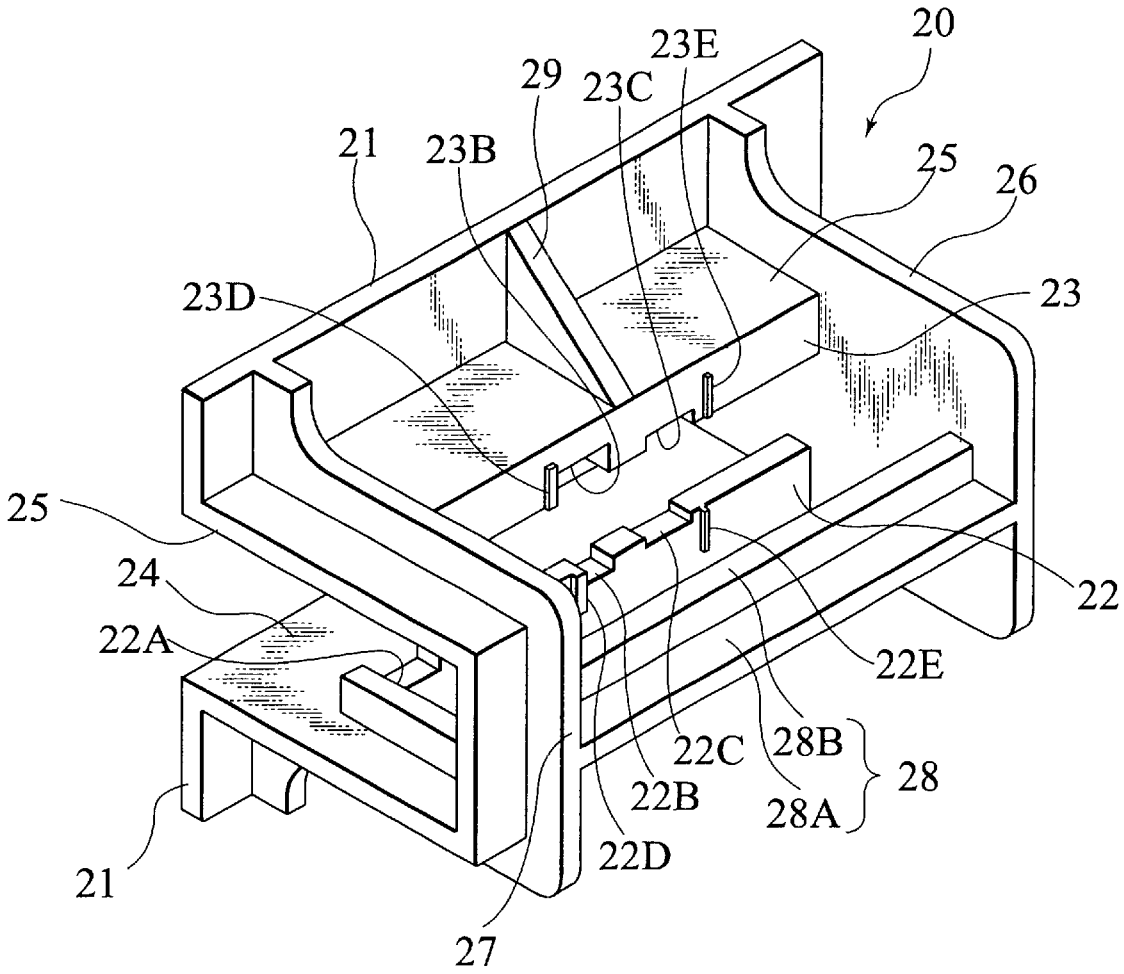
FIG. 3 is a back perspective view of the part in the embodiment.

A structure of the part 20 will be first described by using FIGS. 2 and 3. FIG. 2 is a perspective view in which the part 20 is viewed from a front side and shows a state in which the first connector 30 is inserted into the part 20. FIG. 3 is a perspective view in which the part 20 is viewed from a back side. Although the part 20 prepared separately is fixed to a stay member of the automobile in the present embodiment, the part 20 may be formed integrally with the stay member.

As shown in FIGS. 2 and 3, the part 20 has a rectangular front panel 21 and an upper engagement panel 23 and a lower engagement panel 22 formed and disposed at a predetermined rearward distance from a rectangular opening part 21A formed in the front panel 21, at a vertical distance from each other, and on the identical plane.

In the embodiment, the opening part 21A is formed in a rectangular shape by cutting a side edge of the front panel 21. A transverse dimension of the opening part 21A is set to be larger than that (a width of an opening in a longitudinal direction) of the first connector 30 by a predetermined dimension.

A vertical dimension of the opening part 21A is set to be larger than a height dimension of the second connector 50. A lower reinforcing panel 24 and an upper reinforcing panel 25 are formed to extend rearward and in parallel to each other from lower and upper opening edge parts of the opening part 21A. The lower reinforcing panel 24 is formed integrally with a lower edge part of the lower engagement panel 22. The upper reinforcing panel 25 is formed integrally with an upper edge part of the upper engagement panel 23.

On one side in a transverse direction on a back face of the front panel 21, a rectangular first lateral reinforcing panel 26 is formed integrally with one end edges of the upper engagement panel 23 and the lower engagement panel 22 and one end edges of the lower reinforcing panel 24 and the upper reinforcing panel 25 and extends rearward from the front panel 21. On the other side in a transverse direction on the back face of the front panel 21, a second lateral reinforcing panel 27 having a side face in an angular U shape is formed integrally with the other end edges of the upper engagement panel 23 and the lower engagement panel 22 and the other end edges of the lower reinforcing panel 24 and the upper reinforcing panel 25 and extends rearward from the front panel 21.

Between rear end parts of the first lateral reinforcing panel 26 and the second lateral reinforcing panel 27, a rear reinforcing member 28 is mounted. The rear reinforcing member 28 is formed of a horizontal panel part 28A and a vertical panel part 28B. The panel parts 28A and 28B are formed integrally with each other so as to form a sectional T shape.

As shown in FIG. 3, a triangular reinforcing rib 29 is formed integrally with an intermediate part of the back face of the front panel 21 and an intermediate part of an upper face of the upper reinforcing panel 25. Similarly, a triangular reinforcing rib 29 (not shown) is formed integrally with the intermediate part of the back face of the front panel 21 and an inermediate part of a lower face of the lower reinforcing panel 24.

In a vicinity of the other end part of an upper edge part of the lower engagement panel 22, a cut-out 22A for projection insertion having a depth dimension (i.e., a notched amount from the panel upper edge part) slightly larger than a height dimension of a rear engagement projection 40 formed at a rotary member 32 for engagement of the first connector 30 as described later and a transverse dimension slightly larger than that of the rear engagement projection 40 is formed.

A cut-out 22B for projection insertion and having the identical shape as the cut-out 22A is formed at a predetermined distance (toward the one side of the lower engagement panel 22) from the cut-out 22A on the upper edge part of the lower engagement panel 22. Furthermore, in a vicinity (on the one side of the lower engagement panel 22) of the cut-out 22B, a cut-out 22C for projection accommodation having a depth dimension large enough to house a projection 45 for rotation that will be described later and a small transverse dimension is formed.

At a lower edge part of the upper engagement panel 23 and in positions respectively facing the cut-outs 22A and 22B formed on the lower engagement panel 22, cut-outs 23A and 23B for projection insertion having the identical shapes as the cut-outs 22A and 22B are formed. At a lower edge part of the upper engagement panel 23 and in a position facing the cut-out 22C formed at the lower engagement panel 22, a cut-out 23C for projection accommodation having the identical shape as the cut-out 22C is formed.

As shown in FIG. 3, a first protruding bank 22D and a second protruding bank 22E for limiting a provisionally-fastened position of the first connector 30 are respectively formed along a vertical direction on a back face of the lower engagement panel 22. The first protruding bank 22D is formed in a vicinity of the other side edge of the cut-out 22B. The second protruding bank 22E is formed in a vicinity of the one side edge of the cut-out 22C.

As shown in FIG. 3, on a back face of the upper engagement panel 23, a first protruding bank 23D is formed in a position (in a vicinity of the other side edge of the cut-out 23B) corresponding to the first protruding bank 22D formed at the lower engagement panel 22 and a second protruding bank 23E is formed in a position (in a vicinity of the one side edge of the cut-out 23C) corresponding to the second protruding bank 22E. The first protruding banks 22D and 23D of the upper and lower engagement panels 22 and 23 are higher in such a direction as to project rearward from the panels than the second protruding banks 22E and 23E.

Next, a structure of the first connector 30 will be described by using FIGS. 1, 2, 4A to 4C,and 5A to 5C. The first connector 30 is generally formed of a first connector body 31 substantially in a shape of a rectangular parallelepiped and a pair of rotary members 32 for engagement respectively supported on the first connector body 31. The first connector 30 is inserted into and engaged with the part 20 from a rear end face side from which the rotary members 32, 32 project.

Figure 4A:
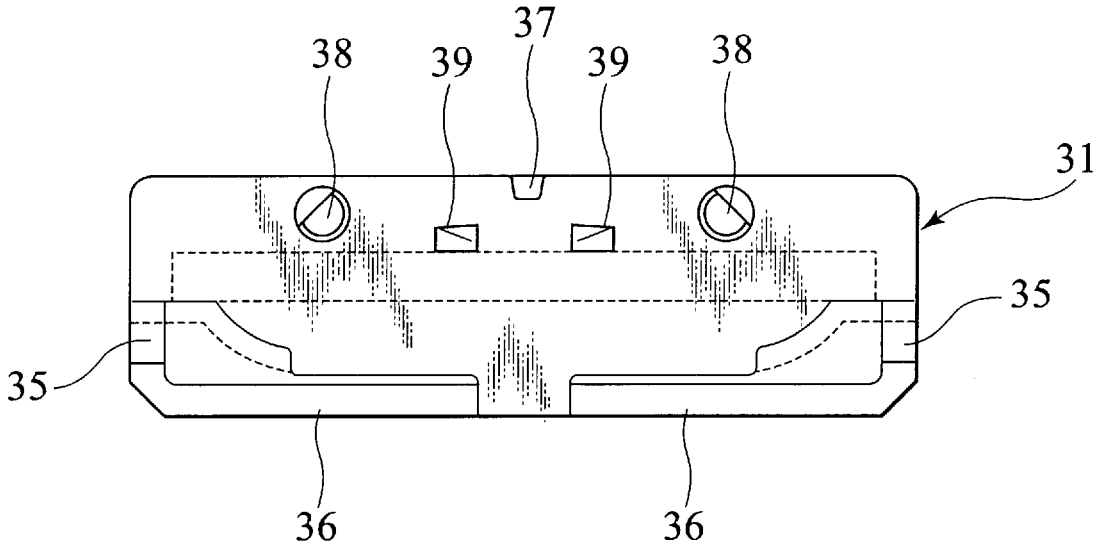
FIG. 4A is a plan view and FIG. 4B is a front view of a first connector body in the embodiment.
Figure 4B:
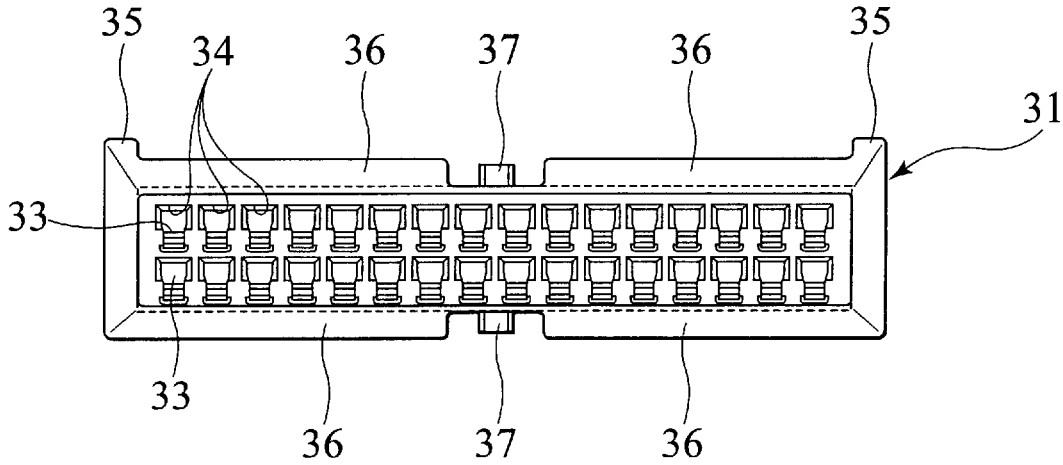

FIGS. 4A and 4B show the first connector body 31 which is not mounted with the rotary members 32. As shown in FIG. 4B, the first connector body 31 has a plurality of terminal accommodation chambers 34 in which female terminal fittings 33 are respectively housed. The female terminal fittings 33 are electrically connected to male terminal fittings 51 on a side of a second connector 50 that will be described later on a front end side of the first connector body 31.

Projections 35 for guide projecting upward are formed on opposite sides of an upper face of a front end of the first connector body 31. Projection banks 36 for guide are formed on left and right at a predetermined distance from each other on each of upper and lower faces of the front end of the first connector body 31. Furthermore, projecting stoppers 37 which limit reverse rotation of the rotary members 32 and with which a front end of the second connector 50 is engaged are respectively formed at central portions of rear edge parts of upper and lower faces of the first connector body 31.

Supporting axes 38 for respectively supporting the rotary members 32 are disposed and provided to project on left and right at a predetermined distance from each other in vicinities of the rear edge part of each of the upper and lower faces of the first connector body 31. Furthermore, projections 39 for provisionally fastening which respectively and provisionally fasten the rotary members 32 supported on the supporting axes 38 are provided to project at a predetermined distance from each other on inner sides of the supporting axes 38 provided to project from each of the upper and lower faces of the first connector body 31.

Figure 5A:
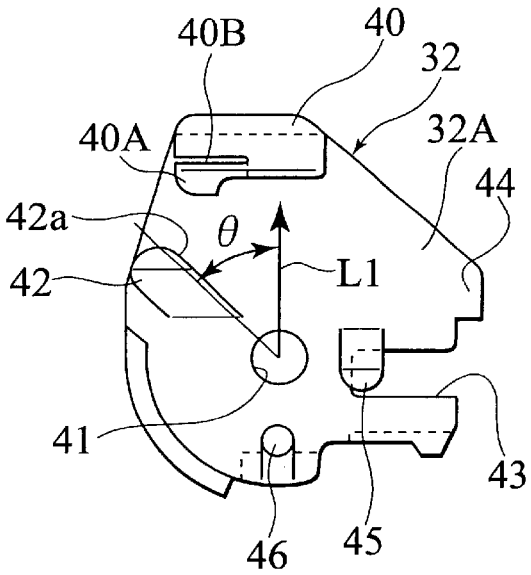
FIG. 5A is a plan view.
Figure 5B:
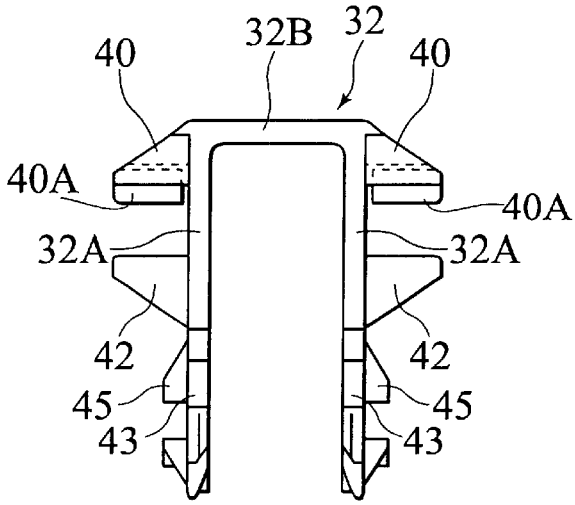
FIG. 5B is a side view.
Figure 5C:
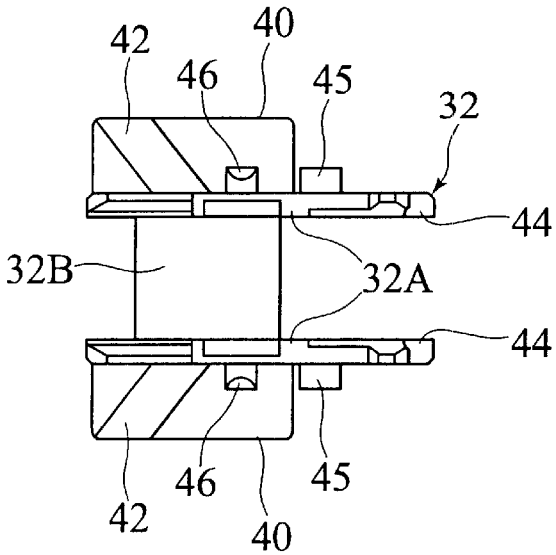
FIG. 5C is a front view of a rotary member for engagement in the embodiment.

Each the rotary member 32 is formed of two parallel plate parts 32A with the identical shapes and a plate part 32B for connection formed integrally with the plate parts 32A so as to connect end parts of the plate parts 32A as shown in FIGS. 5A, 5B, and 5C.

FIG. 5A is a plan view, FIG. 5B is a side view, and FIG. 5C is a front view of the rotary member 32. Each the rotary member 32 can rotate while the plate parts 32A, 32A are supported on the supporting axes 38 formed on the upper and lower faces of the first connector body 31 as shown in FIGS. 1 and 2.

The plate part 32B connects free ends of the rotary member 32 supported on the first connector body 31 through the supporting axes 38. The free end side of the rotary member 32 projects rearward further than the rear end part of the first connector body 31.

Rear engagement projections 40 are formed to project on surfaces of the free end parts of the respective plate parts 32A of the rotary member 32. An engagement part 40A for pressure-contact that can move slightly forward and rearward with repulsion in a pressure-contact direction is formed on a front face side (on a side of an axis hole 41 in which the supporting axis 38 fits) of each the rear engagement projection 40 by forming a slit 40B by cutting a side face of the rear engagement projection 40 as shown in FIG. 5A. The engagement part 40A is brought into pressure-contact with a back face of the lower engagement panel 22 or the upper engagement panel 23 when the first connector 30 is assembled in the part 20.

A front engagement projection 42 is formed to project on a surface of each the plate part 32A as shown in FIGS. 5A, 5B, and 5C, the projection 42 for generating a component of force for rotating the rotary member 32 about the supporting axis 38 when the second connector 50 is fitted with the first connector 30. The front engagement projection 42 is positioned on a rotating direction side of the rotary member 32 to rotate about the supporting axes 38 with respect to a fitting line L1 when the rotary member 32 is in the provisionally-fastened position that will be described later, the fitting line L1 passing through the supporting axes 38 and in a fitting direction where the second connector 50 is fitted with the first connector 30.

More specifically, the front engagement projection 42 is formed to project in a position at a predetermined angle θ in a normal rotation direction in which the rotary member 32 rotates away from the other rotary member 32 on the axis hole 41 in which the supporting axis 38 fits and in a position closer to the axis hole 41 than the rear engagement projection 40. The front engagement projection 42 has substantially the identical height as the rear engagement projection 40. A rear face 42*a* of the front engagement projection 42 is engaged with the surface of the lower engagement panel 22 or the upper engagement panel 23 when the first connector 30 is assembled in the part 20.

Furthermore, in an area of the plate part 32A on the other side of a line connecting the rear engagement projection 40 and the axis hole 41 and in a position at approximately right angle from the rear engagement projection 40 about the axis hole 41, a cut-out 43 for provisionally fastening is formed by notching a peripheral edge of the plate part 32A toward the axis hole 41 as shown in FIG. 5A.

The projection 39 formed to project from the upper or lower face of the first connector body 31 faces each the cut-out 43 to been gaged with. At a peripheral edge parts lightly closer to the free end than the cut-out 43, a stopper engagement part 44 extending slightly away from the axis hole 41 is formed as shown in FIG. 5A.

FIGS. 1 and 2 show a state in which the projections 39 are engaged with the cut-outs 43, i.e., the provisionally-fastened state in which the rotary members 32 cannot rotate. In this provisionally-fastened state of the rotary members 32, the stopper engagement parts 44 of the respective rotary members 32 are engaged with the stoppers 37 respectively formed on the upper and lower faces of the first connector body 31. Therefore, the stoppers 37 prevent the respective rotary members 32 from rotating in such directions that the free ends of the pair of rotary members 32 approach each other. The rear engagement projections 40 are set in advance to be disposed in such positions that all the four rear engagement projections 40 can be simultaneously inserted into the cut-outs 22A, 23A, 22B and 23B of the upper and lower engagement panels 22 and 23 of the part 20 when the rotary members 32 are provisionally fastened to the first connector body 31.

As described above, when the pair of rotary members 32 is in the provisionally-fastened state, each the front engagement projection 42 is at an angle of θ from the fitting line L1 for insertion of the first connector 30 into the part 20 about the supporting axis 38. In each the rotary member 32, the front engagement projections 42 are disposed in directions opposite to the front engagement projections 42 of the other rotary member 32 with respect to the fitting line L1 about the supporting axes 38 as rotation centers. Therefore, if an insertion load (load in insertion) is applied when the first connector 30 is inserted into the part 20, the front engagement projections 42 are engaged with the upper and lower engagement panels 23 and 22 and rotation forces in such directions that the free ends of the respective engagement rotary members 32 move away from each other can be obtained as components of force. As a result, it is possible to reduce the insertion load for assembling the first connector 30 in the part 20.

Furthermore, a projection 45 for rotation and projecting from each the plate part 32A is provided to an end part of each the cut-out 43 on the axis hole 41 side. The projection 45 functions in such a manner that insertion load of the second connector 50 rotates the rotary member 32 when an end part of the second connector 50 is brought into contact with the projection 45. Therefore, in addition to rotation operation of the rotary member 32 by the above component of force of the front engagement projection 42, rotation operation received by the projection 45 acts on the rotary member 32. Thus, by fitting and mounting the second connector 50 to the first connector 30 with the small insertion load, the first connector 30 receives the above rotation operation and is easily assembled in the part 20.

An engagement protrusion 46 that is guided into the second connector 50 to prevent dropping-off of the second connector 50 is formed to project from an end part of each the plate part 32A positioned on an opposite side to the free end with respect to the axis hole 41.

A structure of the second connector 50 will be described next. As shown in FIG. 1, the second connector 50 is substantially in a shape of a tubular prism and has the plurality of male terminal fittings 51 to be connected to the female terminal fittings 33 disposed in the first connector 30 when the first connector 30 is inserted into the second connector 50. On opposite sides of an inner wall face of an upper part of the second connector 50, grooves 52 for guide and corresponding to the projections 35 formed on the first connector body 31 are formed. Receiving parts 53 for engagement are disposed and formed on left and right of each of the upper and lower inner wall faces, the receiving parts 53 to be engaged with the engagement protrusions 46 on the first connector 30.

On outsides of the receiving parts 53 grooves 54 for engagement and into which the engagement protrusions 46 are introduced are formed. Each engagement protrusion 46 introduced from the groove 54 moves along a peripheral face of the receiving part 53 and is engaged with an engagment part 53A for protrusion formed at the receiving part 53.

Next, a method of mounting operation, function, and operation of the part 20, the first connector 30, and the second connector 50 of the present embodiment will be described by using FIG. 2 and FIGS. 6 to 14.

Figure 6:
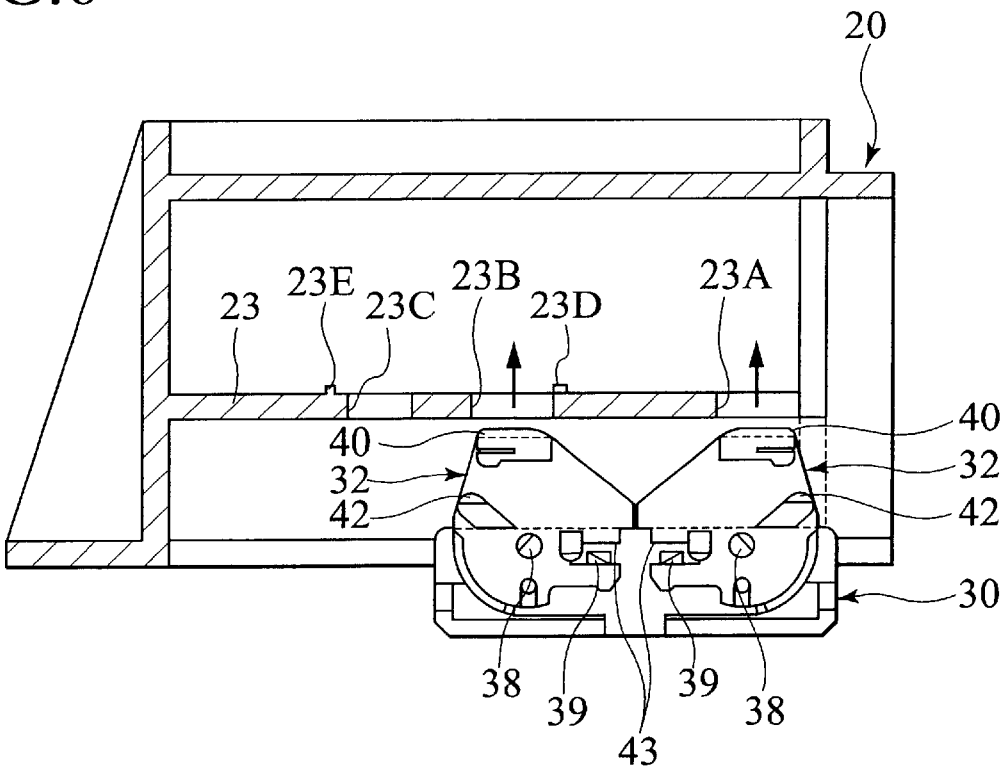
FIG. 6 is a plan partially sectional view showing a state in which the first connector in a provisionally fastened state in the embodiment is assembled in the part.

First, the first connector 30 is inserted into the part 20 in a state in which the rotary members 32, 32 of the first connector 30 are fastened provisionally as shown in FIGS. 2 and 6. The provisionally-fastened state of the rotary members 32 of the first connector 30 is the state in which the projections 39 formed to project from the upper and lower faces of the first connector body 31 face and are engaged in the cut-outs 43 formed at the plate parts 32 of the respective rotary members 32 as described above.

The first connector 30 is inserted into the part 20 by causing the first connector 30 with the provisionally-fastened rotary members 32, 32 to approach the part 20 such that the all four rear engagement projections 40 formed at the free ends of the pair of rotary members 32 correspond to the respective cut-outs 22A, 22B, 23A, and 23B formed at the lower engagement panel 22 and the upper engagement panel 23.

As described above, since the four rear engagement projections 40 cannot pass through the cut-outs 22A, 22B, 23A and 23B formed at the lower engagement panel 22 and the upper engagement panel 23 (the rear engagement projections 40 is brought into contact with the lower engagement panel 22 and the upper engagement panel 23) if the rotary members 32 are not in the provisionally-fastened state (e.g., provisionally fastening is released), it is possible to prevent the first connector 30 from being assembled in an improper position of the part 20. In a state in which the rear engagement projections 40 are inserted to the back face sides of the upper and lower engagement panels 22 and 23, the front engagement projections 42 formed on the rotary members 32 of the first connector 30 are engaged with the front face sides of the upper and lower engagement panels 22 and 23.

Figure 7:
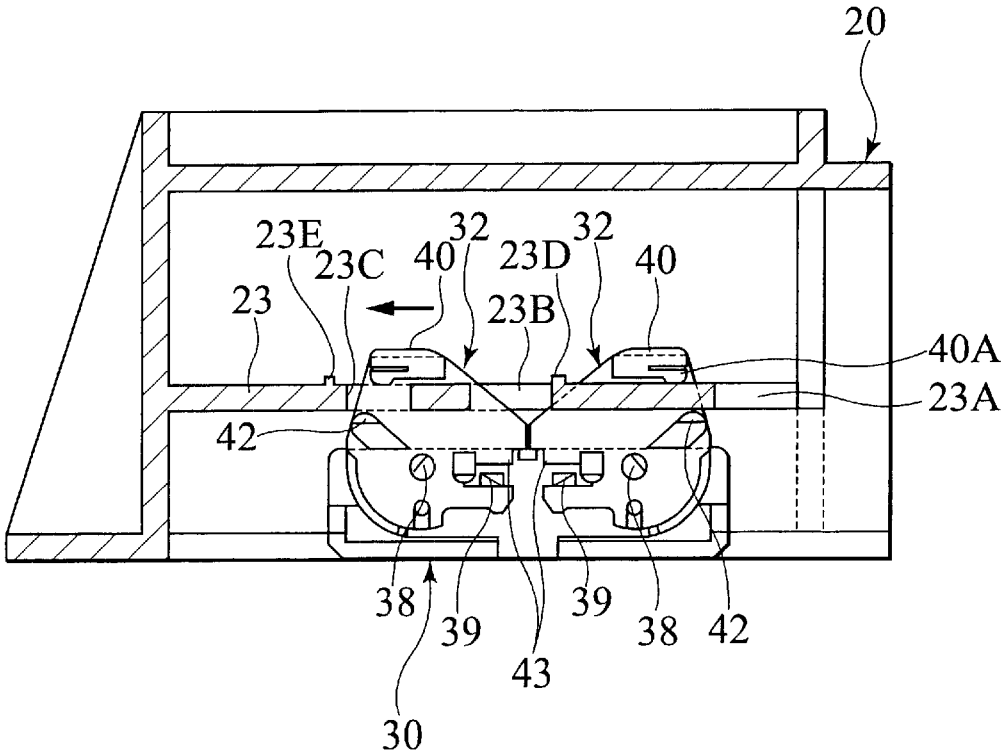
FIG. 7 is a plan partially sectional view showing a state in which the first connector in the provisionally fastened state in the embodiment is assembled in the part and slid.

Next, the all four rear engagement projections 40 formed at the free ends of the pair of rotary members 32 pass through the respective cut-outs 22A, 22B, 23A, and 23B formed at the lower engagement panel 22 and the upper engagement panel 23. The four rear engagement projections 40 reach the back face sides of the lower engagement panel 22 and the upper engagement panel 23. The first connector 30 is slid to the one side (left side in the embodiment) of the part 20 as shown in FIG. 7. The four rear engagement projections 40 reach the back face sides of the lower engagement panel 22 and the upper engagement panel 23. The first connector 23 is slid to the one side (left side in the embodiment) of the part 20 as shown in FIG. 7.

In the above sliding operation, since the rotary members 32 are provisionally fastened to the first connector body 31 when the projections 39 are engaged with the cut-outs 43, rotation of the rotary members 32, 32 is limited. Since the rotary members 32 do not rotate with respect to the first connector body 31 in the sliding, it is possible to reduce tendency of the rear engagement projections 40 and the front engagement projections 42 to loose against or to be caught by the front and back faces of the upper and lower engagement panels 22 and 23.

Such a sliding operation is carried out by holding and sliding the first connector 30 sideways by using a hand. As described below, the first connector 30 can be slid to predetermined positions of the upper and lower engagement panels 22 and 23. As shown in FIG. 7, the rear engagement projections 40 that have passed through the cut-outs 22A, 22B, 23A, and 23B and reached the back face sides of the upper and lower engagement panels 22 and 23 slide and move on the back faces of the upper and lower engagement panels 22 and 23 in the sliding operation.

Figure 8:
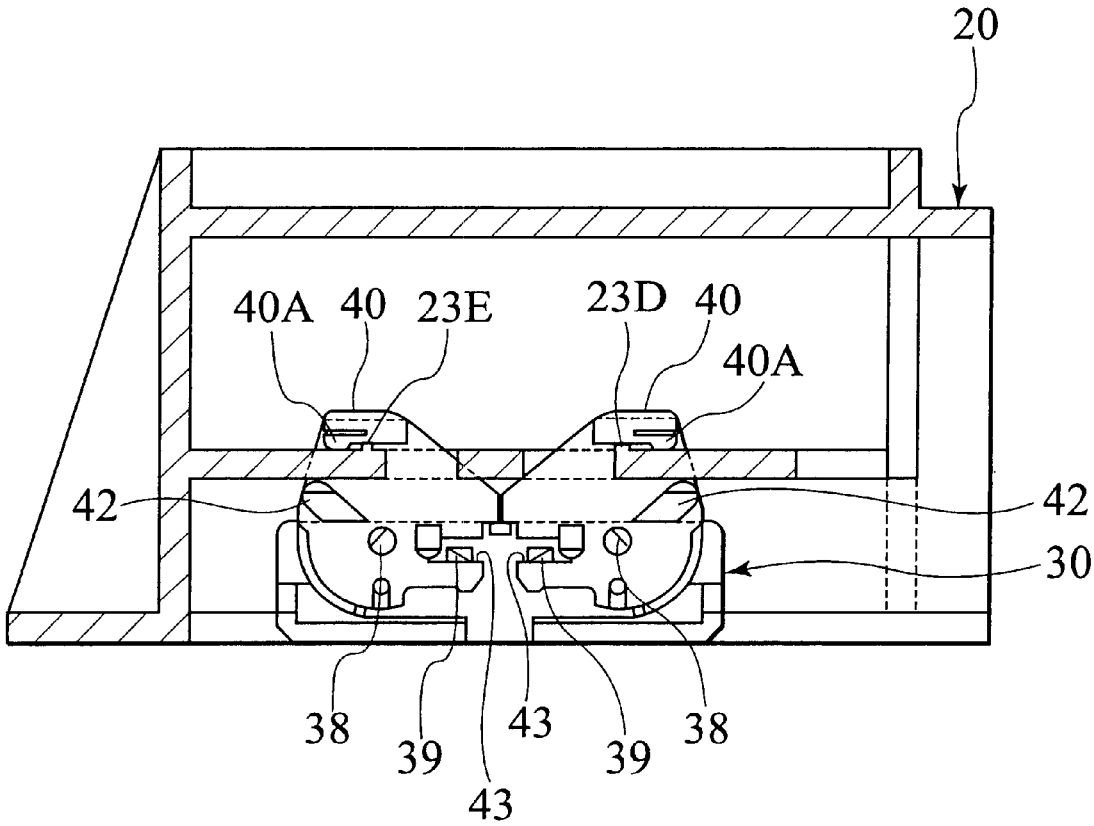
FIG. 8 is a plan partially sectional view showing a state in which the first connector in the embodiment has been moved to a proper position of the part.
Figure 9:
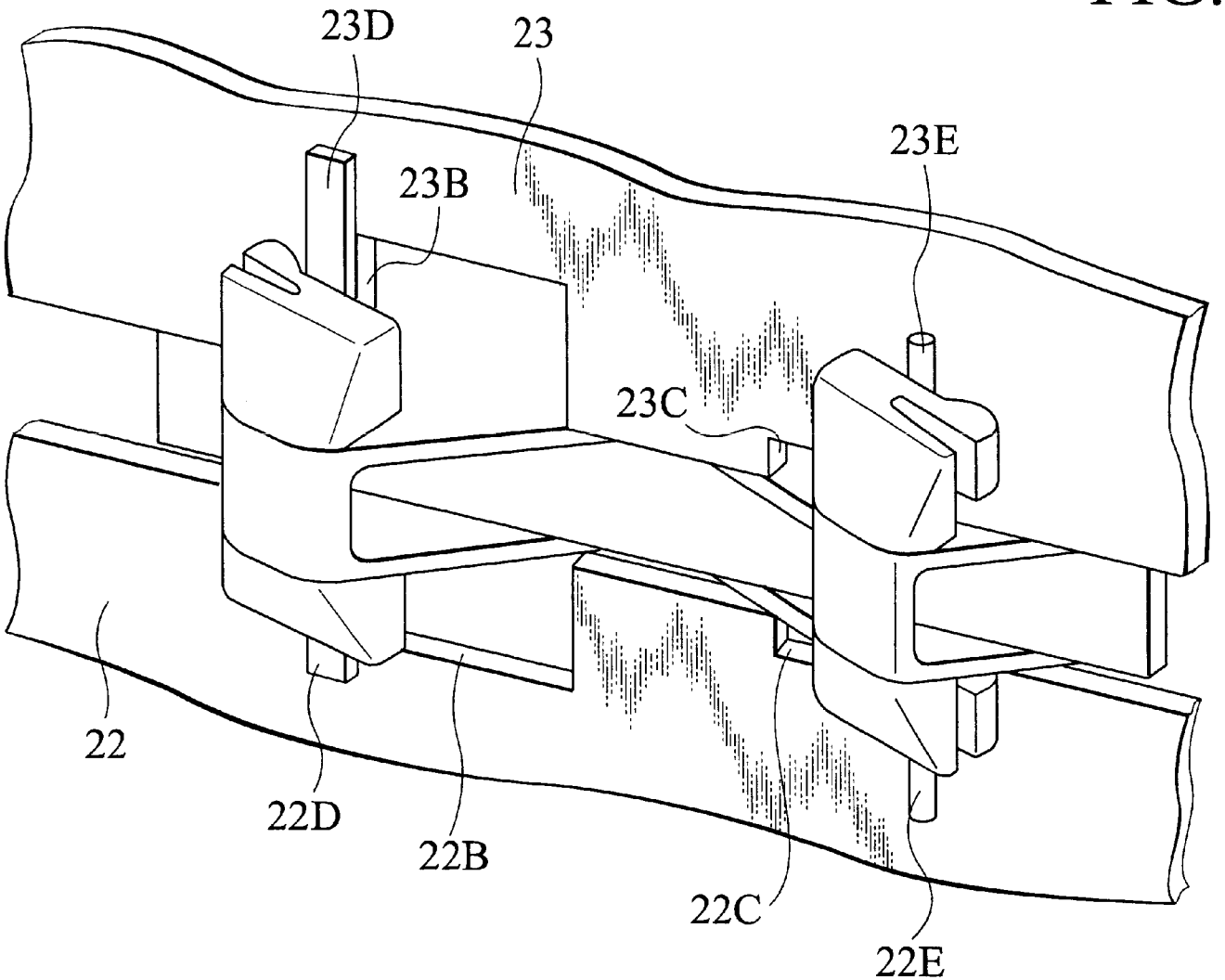
FIG. 9 is a perspective view of the state in which the first connector in the embodiment has been moved to the proper position of the part viewed from a back side of the part.

Then, as shown in FIG. 8, the rear engagement projections 40, 40 that have passed through the cut-outs 22B and 23B pass over the second protruding banks 22E and 23E formed in vicinities of the one side edges of the cut-outs 22C and 23C. FIG. 9 shows a state in which the rear engagement projections 40 are in predetermined positions viewed from back sides of the upper and lower engagement panels 22 and 23.

As described above, since the first protruding banks 23D and 22D of the upper and lower engagement panels 22 and 23 project further rearward from the panels than the second protruding banks 23E and 22E, the rear engagement projections 40 which have passed through the cut-outs 22A and 23A cannot pass over the first protruding banks 22D and 23D. Therefore, the first protruding banks 22D and 23D function as positioning members.

Figure 10:
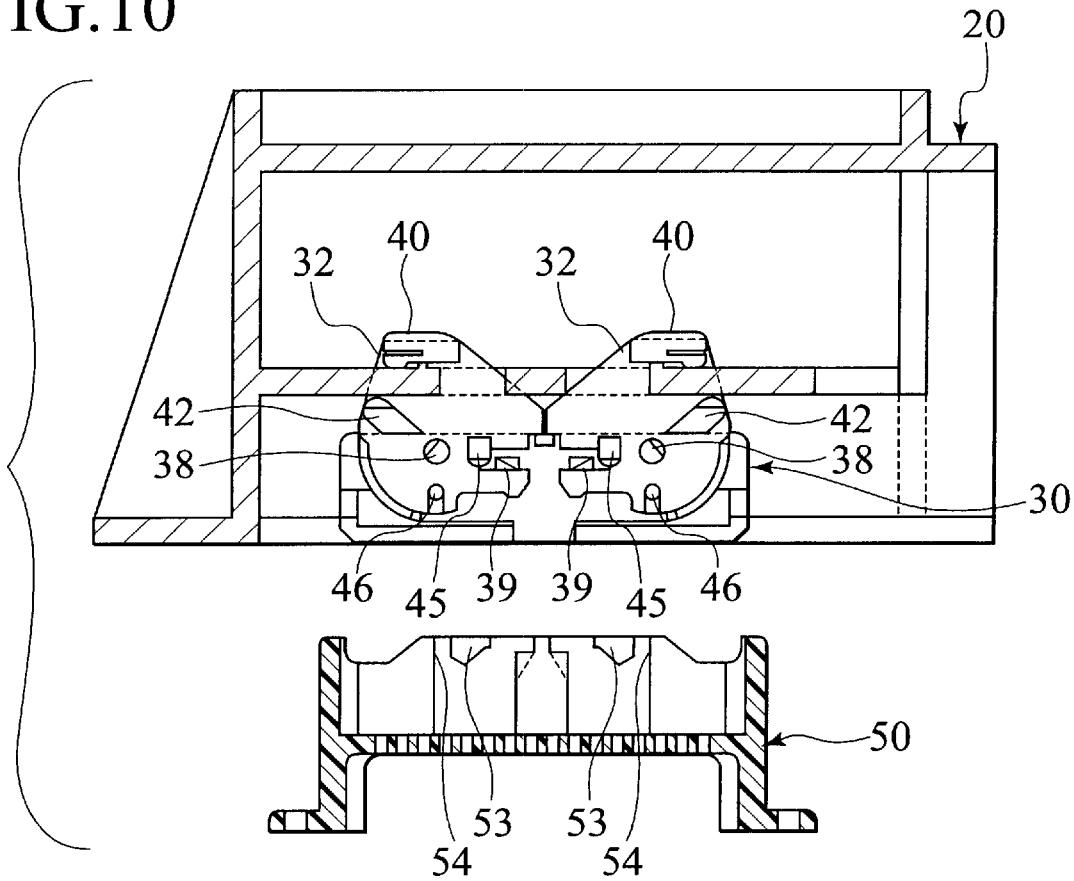
FIG. 10 is a plan partially sectional view showing a state in which a second connector is mounted to the first connector that is provisionally fastened to the part.

Next, as shown in FIGS. 1 and 10, the second connector 50 is caused to approach the first connector 30. The second connector 50 is fitted in the first connector 30 such that the projections 35 formed on opposite sides of the upper face of the front end of the first connector body 31 are fitted in the grooves 52 formed on the opposite sides of the upper inner wall face of the second connector 50. At this time, engagement protrusions 46 formed at the font end parts of the rotary members 32 enter the grooves 54 formed on the upper and lower inner wall faces of the second connector 50.

Figure 11:
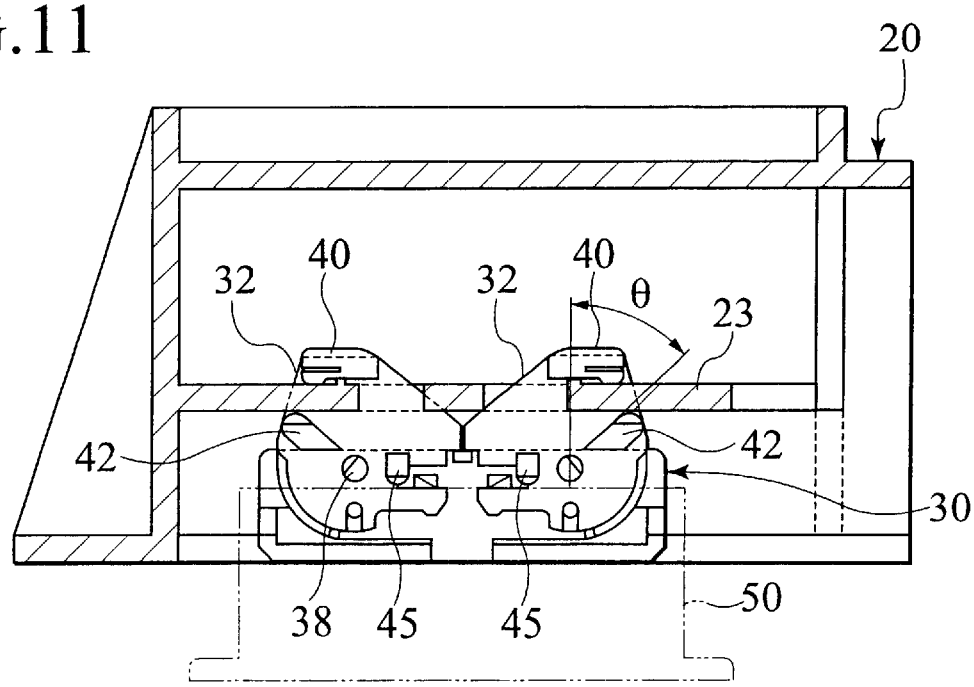
FIG. 11 is a plan partially sectional view showing an initial state in which the second connector in the embodiment is fitted with the first connector.
Figure 12:
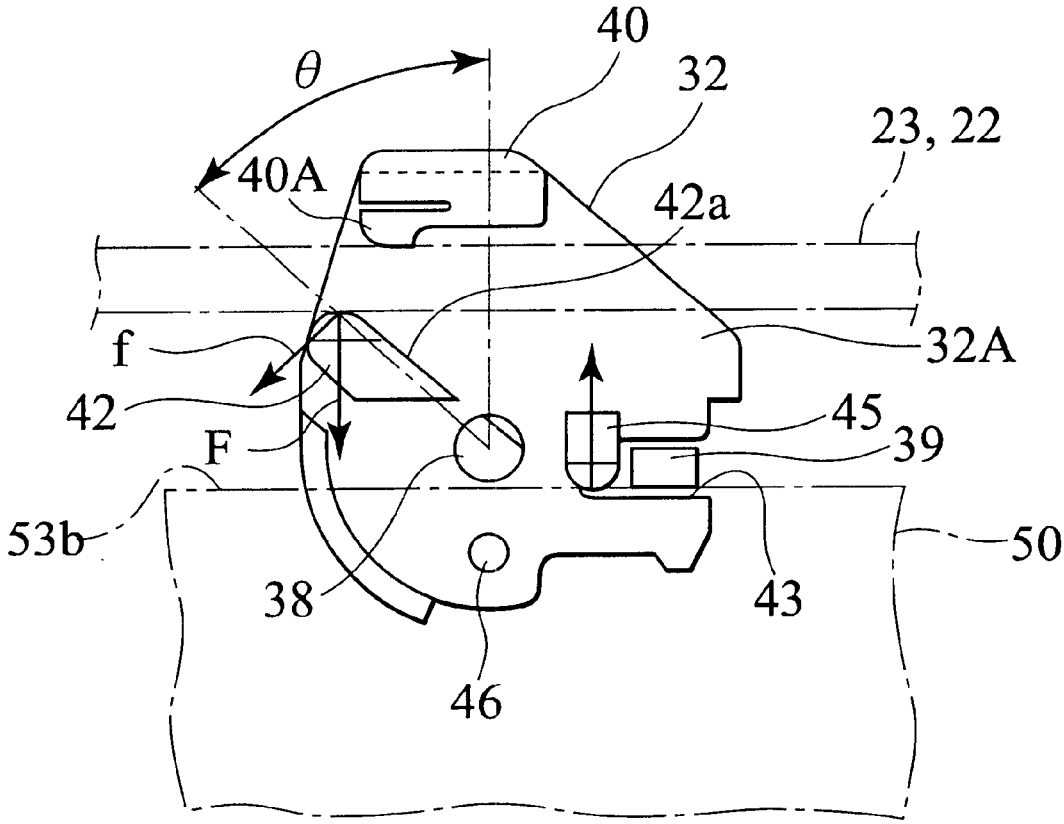
FIG. 12 is an explanatory view of an essential part of the initial state in which the second connector in the embodiment is fitted with the first connector.

Then, if the second connector 50 is pushed in such that the second connector 50 is fitted into the first connector 30 by force that can release the above provisionally-fastened state as shown in FIG. 11, end faces 53*b* of the receiving parts 53 of the second connector 50 push the projections 45 of the rotary members 32 rearward as shown in FIG. 12. Therefore, the rotary members 32, 32 of the pair are rotated in such directions that the rear engagement projections 40 of the rotary members 32, 32 move away from each other. In addition, when the first connector 30 is pushed toward the part 20, the front engagement projection 42 receives reaction force F from the upper engagement panel 23 (or the lower engagement panel 22) as shown in FIG. 12. A component f of the reaction force F functions as force for reducing fitting force at the start of mounting by fitting which rotates the rotary members 32 in such directions that the rear engagement projections 40 move away from each other.

As a result, the projections 39 are detached from the cut-outs 43 formed at the plate parts 32A. Thus, the provisionally-fastened state of the rotary members 32 with respect to the first connector body 31 are released. As described above, engagement of the cut-outs 43 and the projections 39 with each other can be carried out easily by the above operation.

Figure 13:
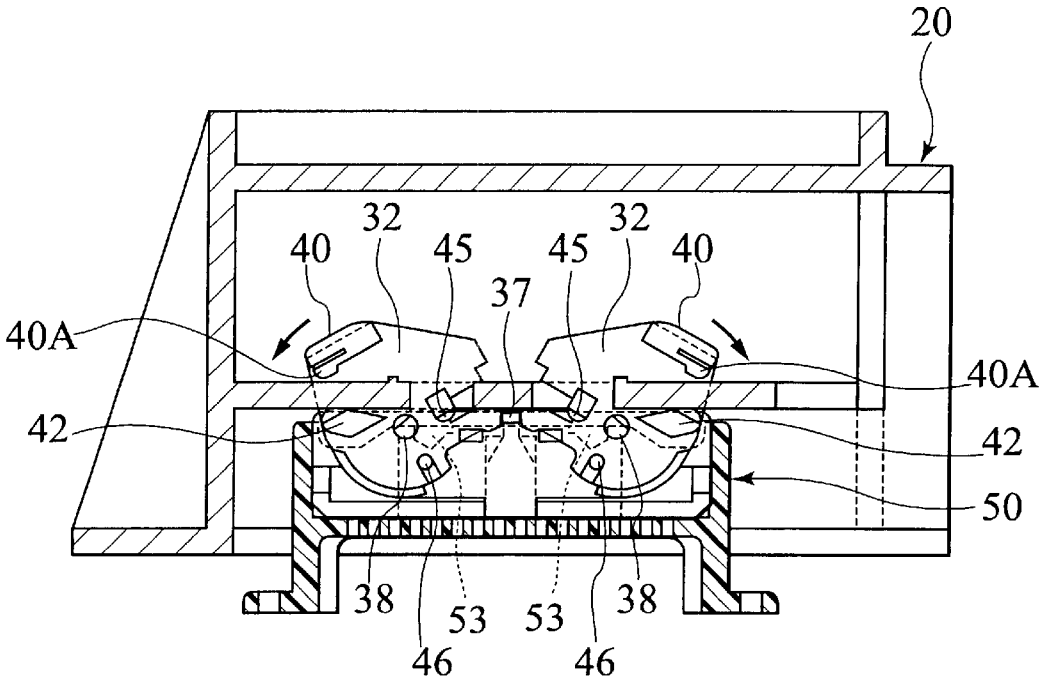
FIG. 13 is a plan partially sectional view showing an intermediate state in which the second connector is mounted to the first connector in the embodiment.

Besides, since the rotary members 32 can be rotated by a smaller insertion load after the provisionally fastening is released, it is easy to insert the second connector 50 into the first connector 30 and engage the first connector 30 with the part 20. In other words, if the rear engagement projections 40 move away from each other and the lower engagement panel 22 and the upper engagement panel 23 are held between the front engagement projections 42 and the rear engagement projections 40 as shown in FIG. 13, the first connector 30 is engaged with and fixed to the part 20.

Figure 14:
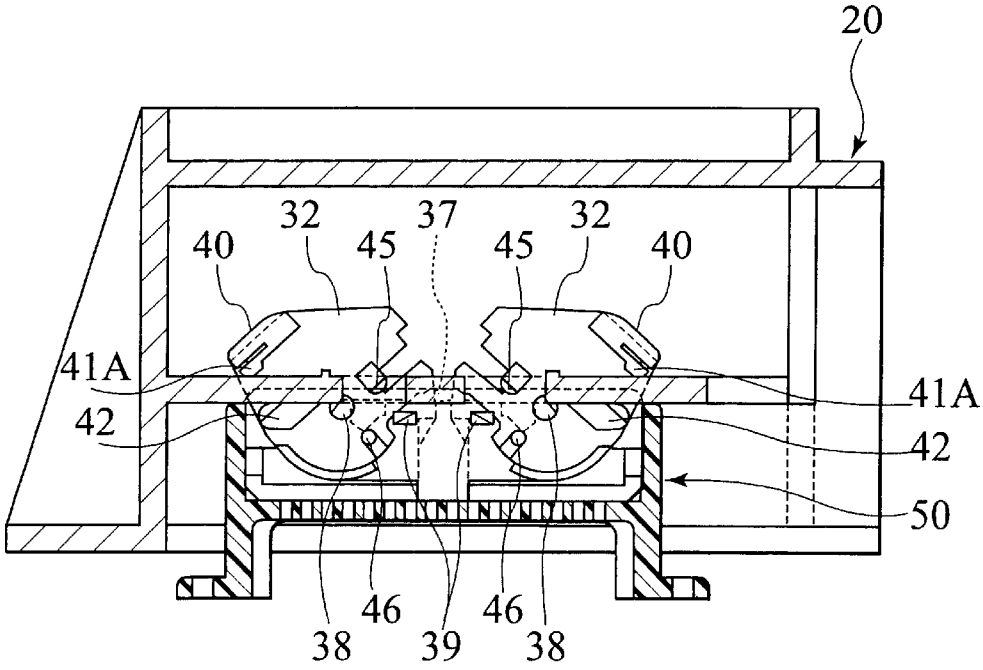
FIG. 14 is a plan partially sectional view showing a state in which the second connector is completely mounted to the first connector in the embodiment.

Then, by pushing the second connector 50 until the end faces of the second connector 50 are engaged with the stoppers 37 formed on the first connector body 31 as shown in FIG. 14, the second connector 50 is completely connected to the first connector 30. At this time, the engagement protrusion 46 formed at the front end of each the rotary member 32 of the first connector 30 rotates to move around the back side of the receiving part 53 and is positioned at the rear of the engagement part 53A shown in FIG. 1 to perform function of preventing dropping off of the second connector 50. With the above operations, assembly of the first connector 30 and the second connector 50 connected to each other in the part 20 is completed.

Since the front engagement projections 42 for generating components of force for rotating the rotary members 32 on the supporting axes 38 in fitting of the second connector 50 into the first connector 30 are provided in the embodiment, the components of force for rotating the rotary members 32 are generated and the insertion load for inserting the first connector 30 and the second connector 50 can be reduced. Therefore, the first connector 30 and the second connector 50 can be assembled easily and reliably.

When the rotary members 32 are rotated, the engagement parts 40A of the rear engagement projections 40 are brought into contact with the back faces of the lower engagement panel 22 and the upper engagement panel 23 with repulsion in the embodiment. As a result, the panels can be firmly held between the rear engagement projections 40 and the front engagement projections 42 and generation of loosing of the first connector 30 can be prevented.

Although the embodiment has been described above, the invention is not limited to the embodiment and various modifications in design according to the summary of the structure may be made. For example, although the pair of rotary members 32 is provided to the first connector 30 in the above embodiment, one, three, or more rotary members 32 may be provided.

What is claimed is:

1. A connector support structure comprising:

a part for receiving a first connector, the part comprising an engagement panel configured to engage and support a rear end side of the first connector;

the first connector comprising:

a first connector body; and a rotary member being supported on the first connector body by a supporting axis, the rotary member further comprising:

a rear engagement projection configured to engage a rear surface of the engagement panel; and a front engagement projection configured to engage a front surface of the engagement panel; and a second connector configured to be fitted with the front end side of the first connector, the first connector and the second connector being electrically joined each other, wherein the front engagement projection is positioned to generate a tangential force for rotating the rotary member about the supporting axis when the second connector is fitted with the first connector.

2. A connector support structure according to claim 1, wherein the front engagement projection is positioned on a rotation side of the rotary member about the supporting axis relative to a fitting line, the fitting line passing through the supporting axis in a fitting direction where the second connector is fitted with the first connector.

3. A connector comprising:

a part for receiving a first connector, the part comprising at least one engagement panel configured to engage and support a rear end side of the first connector;

the first connector comprising:

a first connector body; and a pair of rotary members, each of the rotary members being supported on the first connector body by a supporting axis and comprising:

a rear engagement projection configured to engage a rear surface of the engagement panel; and a front engagement projection configured to engage a front surface of the engagement panel; and a second connector configured to be fitted with the front end side of the first connector, the first connector and the second connector being electrically joined each other, wherein the front engagement projection of each of the rotary members is positioned to generate a tangential force for rotating the rotary member about the supporting axis when the second connector is fitted with the first connector.

4. A connector comprising:

a first connector having a first connector body and a rotary member being rotatable with respect to a rotating axis substantially parallel to a surface of the engagement panel;

a second connector configured to engage with the first connector;

a part comprised of an engagement panel configured to receive and support the first connector; and the rotary member comprising a first engagement member and a second engagement member for holding the engagement panel therebetween, wherein, prior to an engagement between the first connector and the second connector, the first engagement member contacts a rear surface of the engagement panel and a second engagement member contacts a front surface of the engagement panel for supporting the first connector.

5. A connector according to claim 4, further comprising:

the rotary member being capable of rotating with respect to a supporting axis;

the first engagement member having a first contact point between the first engagement member and the rear surface of the engagement panel, the first contact point having a first distance from the supporting axis and a first angle formed with respect to a fitting line, the fitting line passing through the supporting axis in a fitting direction where the second connector is fitted with the first connector; and the second engagement member having a second contact point between the second engagement member and the front surface of the engagement panel, the second contact point having a second distance from the supporting axis and a second angle formed with respect to the fitting line, wherein the first distance and the second distance are different from each other and the first angle and the second angle are different from each other.

6. A connector according to claim 4, further comprising:

the rotary member being capable of rotating with respect to a rotation center;

the first engagement member having a first contact point between the first engagement member and the rear surface of the engagement panel, the first contact point having a first distance from the rotation center and a first angle formed with respect to a fitting line, the fitting line passing through the supporting axis in a fitting direction where the second connector is fitted with the first connector; and the second engagement member having a second contact point between the second engagement member and the front surface of the engagement panel, the second contact point having a second distance from the supporting axis and a second angle formed with respect to the fitting line, wherein the first distance is greater than the first distance, and the first angle is smaller than the second angle so that an insertion load for the first connection into the part is reduced.

7. A connector according to claim 4, wherein the second engagement member exerts inward radial force on the rotary member.

8. A connector according to claim 4, wherein the first connector comprises a fastening projection and the rotary member defines a cut-out part for engagement with the fastening projection.

9. A connector according to claim 4, further comprising the second connector having a receiving part configured to be brought into contact with the rotary member.

10. A connector according to claim 9, wherein the rotary member comprises an engagement protrusion configured to engage with the second connector.

11. A connector according to claim 4, wherein the first engagement member comprises a resilient part to engage with the part.

12. A connector according to claim 4, further comprising at least one protruding bank positioned on the rear surface of the engagement panel for positioning first engagement member.

13. A connector according to claim 4, further comprising a rotation projection projecting from the rotary member, wherein the rotary member is rotated when the second connector engages with the first connector by having a portion of the second connector configured to contact with the rotation projection and push the rotation projection in a direction of insertion.

14. A connector according to claim 4, wherein the rotary member is rotatably coupled to a supporting axis of the first connector body.

* * * * *

UNITED STATES PATENT AND TRADEMARK OFFICE

CERTIFICATE OF CORRECTION

PATENT NO. : 6,644,990 B1
DATED : November 11, 2003
INVENTOR(S) : Toshiaki Okabe et al.

It is certified that error appears in the above-identified patent and that said Letters Patent is hereby corrected as shown below:

Column 10,
Line 39, "joined each" should read -- joined to each --.
Line 66, "joined each" should read -- joined to each --.

Column 12,
Line 14, "than the first distance," should read -- than the second distance, --.

Signed and Sealed this

Fifteenth Day of June, 2004

JON W. DUDAS
*Acting Director of the United States Patent and Trademark Office*